US006321932B1

(12) United States Patent
Butters, III

(10) Patent No.: US 6,321,932 B1
(45) Date of Patent: Nov. 27, 2001

(54) NON-SLIP BUCKET HOLDER FOR ANGLED SURFACES

(76) Inventor: Byron Butters, III, 719 E. Rollercoaster Dr., Guthrie, OK (US) 73044

( * ) Notice: Subject to any disclaimer, the term of this patent is extended or adjusted under 35 U.S.C. 154(b) by 0 days.

(21) Appl. No.: 09/474,386

(22) Filed: Dec. 29, 1999

(51) Int. Cl.[7] ..... B65D 25/22
(52) U.S. Cl. ..... 220/737; 220/631
(58) Field of Search ..... 220/737, 608, 220/631, 630, 23.83, 23.86, 23.87, 23.91; 248/148

(56) References Cited

U.S. PATENT DOCUMENTS 445,719 * 2/1891 Schillinger .
753,942 * 3/1904 Wallace .
983,473 * 2/1911 Barnes .
1,268,017 * 5/1918 Knight .
1,744,103 * 1/1930 Burrows .
4,001,444 * 1/1977 Clarke ..... 426/110
5,232,187 * 8/1993 O'Farrell et al. ..... 248/148
5,236,340 * 8/1993 Hall et al. ..... 220/606
5,704,711 * 1/1998 Simmons ..... 366/199
5,727,708 * 3/1998 Erickson ..... 220/23.87
5,921,431 * 7/1999 Pych ..... 220/742
5,934,627 * 8/1999 Lewis et al. ..... 248/148

* cited by examiner

*Primary Examiner*—Stephen Castellano
(74) *Attorney, Agent, or Firm*—Gene Scott-Patent Law & Venture Group

(57) ABSTRACT

A combination bucket and bucket holding apparatus, includes a bucket of the type that is commonly used in construction trades, and a bucket holding apparatus comprising a cylindrical body part having a closed end at one end thereof, and integral thereto, a sidewall with a flared annular edge at an open opposing end thereof, the closed end comprising a flat plate set at an angle to the longitudinal axis of the body part, so that the apparatus may be set onto a non-horizontal surface with the longitudinal axis of the body part plumb and a bucket supporting means fitted within the sidewall, the bucket supporting means providing a rest surface normal to the longitudinal axis for supporting the bucket within the apparatus.

7 Claims, 2 Drawing Sheets

NON-SLIP BUCKET HOLDER FOR ANGLED SURFACES

For purposes of establishing an earlier priority date in the present application a previously filed provisional patent application having Ser. No. 60/114,440 and an assigned filing date of Dec. 31, 1998 and which contains subject matter substantially the same as that described and claimed in the present application is herein identified.

BACKGROUND OF THE INVENTION

1. Field of the Invention

This invention relates generally to roofing tools and equipment, and more particularly to a bucket holder for supporting a bucket in a preferred attitude on a sloped roof 2. Description of Related Art Buckets are used extensively by workmen on roofing operations. Such operations include surfacing and repairing or replacement of surfaces. The buckets that are used are typically of the round cylindrical type with a hinged handle for carrying them. However these buckets are in advantageously used in that when set to rest on a pitched roof the contents of the bucket tends to overflow the downhill side of the bucket since the bucket is at an angle to the horizontal. Further, these buckets tend to slide off the pitched roof. No solution to this problem has been discovered until now with the result that workmen have been hurt by buckets slipping off roofs upon which they were placed.

The prior art teaches the use of buckets in roof installation and repair work. However, the prior art does not teach that such a bucket may be supported in an upright attitude by a non-slip surfaced bucket holder. The present invention fulfills these needs and provides further related advantages as described in the following summary.

SUMMARY OF THE INVENTION

The present invention teaches certain benefits in construction and use which give rise to the objectives described below.

The above described drawing figures illustrate the invention, a combination of a bucket and a bucket holding apparatus, the combination comprising a bucket of the type that is commonly used in construction trades, and a bucket holding apparatus comprising a cylindrical body part having a closed end at one end thereof, and integral thereto, a sidewall with a flared annular edge at an open opposing end thereof, the closed end comprising a flat plate set at an angle to the longitudinal axis of the body part, so that the apparatus may be set onto a non-horizontal surface with the longitudinal axis of the body part plumb and a bucket supporting means fitted within the sidewall, the bucket supporting means providing a rest surface normal to the longitudinal axis for supporting the bucket within the apparatus.

A primary objective of the present invention is to provide a means for supporting a bucket on a sloped roof which has advantages not taught by the prior art.

Another objective is to provide such a means that is easily manufactured at low cost.

A further objective is to provide such a means that is easily handled for moving from place to place.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 4:
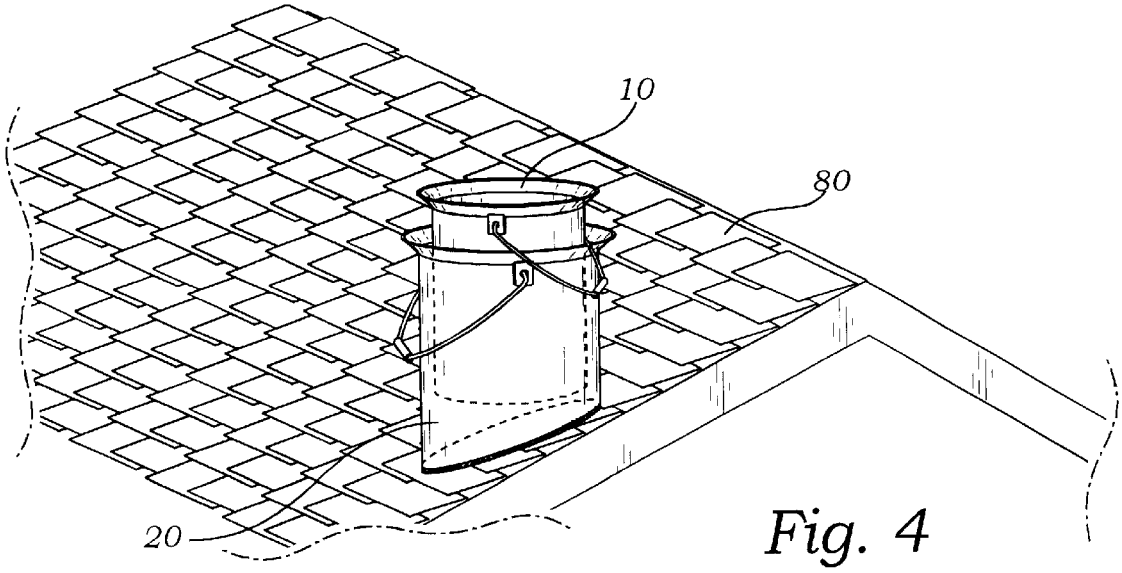
FIG. 4 is a perspective view showing the invention in use on a roof.

The above described drawing figures illustrate the invention, a combination of a bucket 10 and a bucket holding apparatus 20, the bucket 10 being of the type that is commonly used in construction trades for carrying water, solvents, waterproofing compounds and the like. The bucket holding apparatus 20 is quite similar in shape and construction to the bucket, preferably molded plastic, and comprises a tapered cylindrical body part 30 having a closed end 40 at one end thereof, and integral thereto, a sidewall 50 with a flared annular edge 60 at an open opposing end thereof so that liquids may be easily poured therefrom. The closed end 40 comprises a flat plate set at an angle to the longitudinal axis 70 of the body part 30, so that the apparatus 20 may be set onto a non-horizontal surface 80 with the longitudinal axis 70 of the body part 30 plumb, i.e., vertical. A bucket supporting means 90 is fitted within the sidewall 50, the bucket supporting means providing a rest surface 100 normal to the longitudinal axis 70 for supporting the bucket 10 within the apparatus as is clearly shown in FIG. 4.

The flat plate of the closed end 40 inventively has a non-slip exterior surface 42 which may be made with a rough surface finish or it may have a rubber, neoprene or silicone coating, or other high friction material applied or layer attached.

Figure 1:
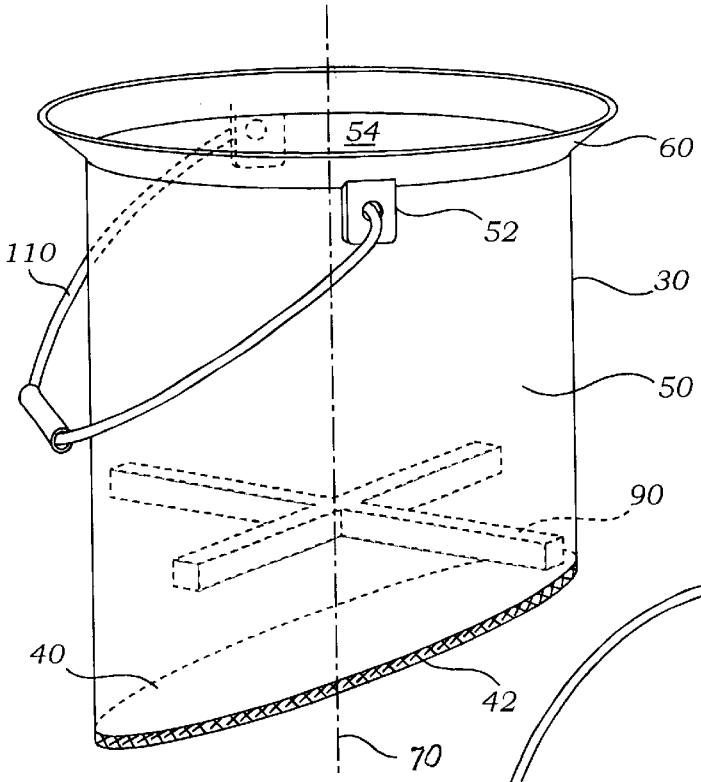
FIG. 1 is a perspective side elevational view of the preferred embodiment of the present invention.
Figure 2:
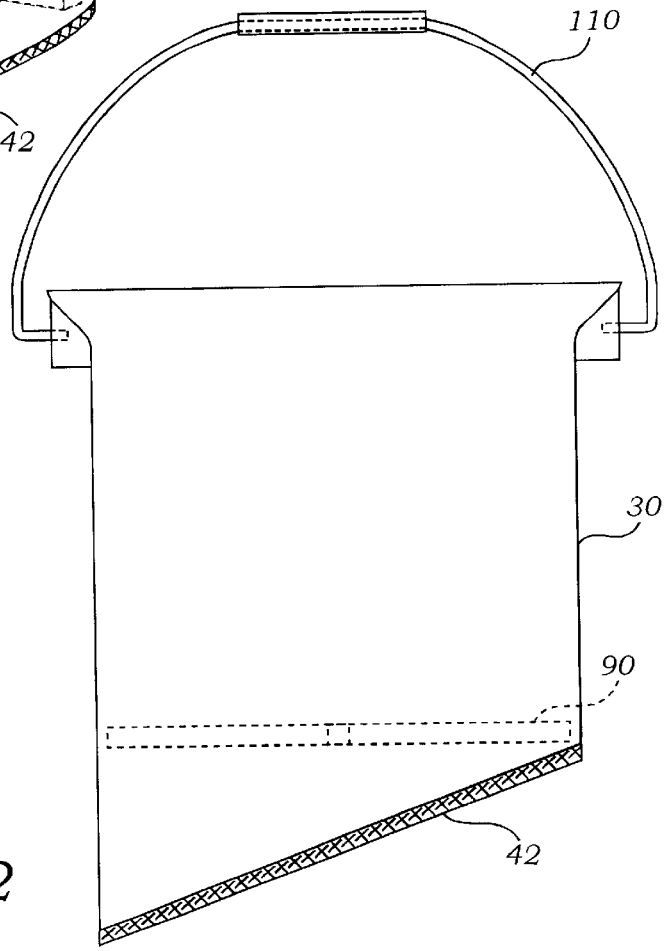
FIG. 2 is a side elevational view thereof.
Figure 3:
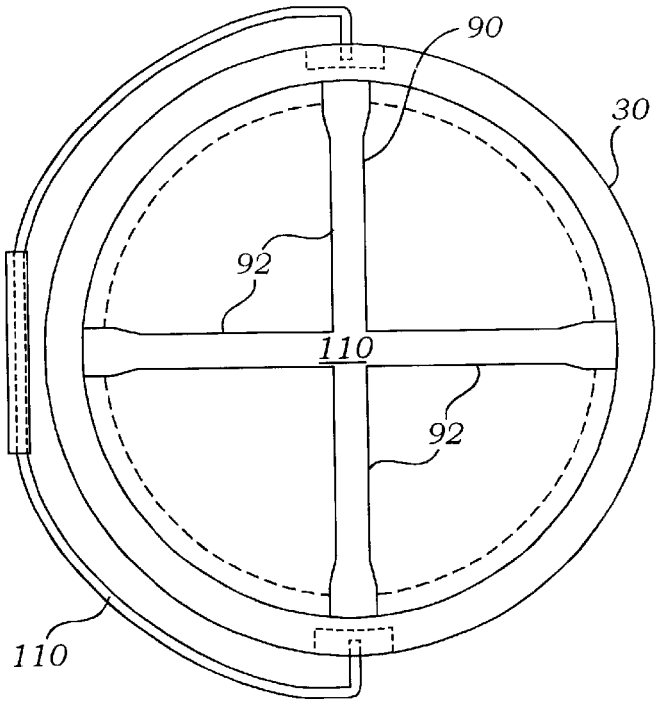
FIG. 3 is a plan view thereof.

The apparatus inventively further comprises a carrying handle 110 engaged near the open end of the body part 30 which is adapted, by its mounting and by its size, for rotating from a vertical position, as shown in FIG. 2, for carrying the apparatus to a rest position, as shown in FIG. 1, at one side of the apparatus 20. The carry handle is mounted rotationally in a pair of handle mounting bosses 52 molded integrally to the apparatus as shown in the figures.

The bucket supporting means 90 inventively provides at least three radially extending legs 92 forming a tight-fitting contact with an inside surface 54 of the sidewall 50. The legs 92 are of such size as to enable the supporting means 90 to be wedged into the sidewall 50.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination of a bucket and a bucket holding apparatus, the combination comprising:

a bucket; and a bucket holding apparatus comprising:

a cylindrical body part having a closed end at one end thereof, and integral thereto, a sidewall with a flared annular edge at an open opposing end thereof;

the closed end being a single planar plate set at an angle to the longitudinal axis of the body part, so that the apparatus may be set onto a non-horizontal surface with the longitudinal axis of the body part plumb; and a removable bucket supporting means fitted within the sidewall, the bucket supporting means providing a rest surface normal to the longitudinal axis for supporting the bucket within the apparatus.

2. The apparatus of claim 1 wherein the single planar plate has a non-slip exterior surface.

3. The apparatus of claim 1 further comprising a carrying handle engaged near the open end of the body part and adapted for rotating from a vertical position for carrying the apparatus to a rest position at one side of the apparatus.

4. The apparatus of claim 1 wherein the bucket supporting apparatus provides at least three radially extending legs of a length enabled for forming a tight-fitting contact with an inside surface of the sidewall supporting the radially extending legs horizontally and spaced away from the closed end.

5. An apparatus comprising:

a cylindrical body part having a closed end at one end thereof, and integral thereto, a sidewall with a flared annular edge at an open opposing end thereof;

the closed end being a single planar plate set at an angle to the longitudinal axis of the body part, the angle of such magnitude that the apparatus may be set onto a non-horizontal surface with the longitudinal axis of the body part plumb; and a removable bucket supporting means fitted within the sidewall, the bucket supporting means providing a rest surface normal to the longitudinal axis for supporting a bucket within the apparatus; wherein the bucket supporting apparatus provides at least three radially extending legs of a length enabled for forming a tight-fitting contact with an inside surface of the sidewall supporting the radially extending legs horizontally and spaced away from the closed end.

6. The apparatus of claim 5 wherein the single planar plate has a non-slip exterior surface.

7. The apparatus of claim 5 further comprising a carrying handle engaged near the open end of the body part and adapted for rotating from a vertical position for carrying the apparatus to a rest position at one side of the apparatus.

* * * * *